US006468049B1

(12) United States Patent
Hung

(10) Patent No.: US 6,468,049 B1
(45) Date of Patent: Oct. 22, 2002

(54) COMBINATION AIR COMPRESSOR-LIFTING JACK

(75) Inventor: Michael Hung, Lu Chu Hsiang (TW)

(73) Assignee: Shinn Fu Corporation, Tao Yuan (TW)

( * ) Notice: Subject to any disclaimer, the term of this patent is extended or adjusted under 35 U.S.C. 154(b) by 2 days.

(21) Appl. No.: 09/879,980

(22) Filed: Jun. 14, 2001

(51) Int. Cl.[7] ..... F04B 53/00
(52) U.S. Cl. ..... 417/234; 417/415; 92/51
(58) Field of Search ..... 417/234, 360, 417/415; 92/51, 52, 53

(56) References Cited

U.S. PATENT DOCUMENTS 4,187,058 A * 2/1980 Fish ..... 417/234
5,11207 A * 5/1992 Doolittle et al. ..... 417/312
6,199,693 B1 * 3/2001 Hung ..... 206/349

* cited by examiner

*Primary Examiner*—Charles G. Freay
*Assistant Examiner*—John F Belena
(74) *Attorney, Agent, or Firm*—Bacon & Thomas, PLLC

(57) ABSTRACT

An air compressor capable of being mounted across a lifting jack is disclosed. The air compresssor outer housing has a lower section that has a inverted "u" shape cavity to be mounted across the two vertical side plates of the lifting jack to be combined into a single unit. Therefore the air compressor can be stored, transported or operated.

Within the outer housing of the air compressor, on each side face there is a cavity with a cover for opening and closing. These cavities create storage for the power-cord and hose/connector when not in use.

The top surface inside the inverted "u" section is formed with a sloping angle approximately matching the sloping top edge of the two vertical plates. This allows the air compressor to be clamped in an approximate horizontal inclination for easier operation.

8 Claims, 5 Drawing Sheets

COMBINATION AIR COMPRESSOR-LIFTING JACK

FIELD OF THE INVENTION

The present invention relates to an air compressor that mounts onto a lifting jack and thus becomes part of the lifting jack creating a single product in its entirety.

BACKGROUND OF THE INVENTION

Conventional Air Compressors that are in the market today are normally self-contained units, with the mechanism usually inside an outer case with a carry handle. The conventional 12-volt compressors come with the standard accoutrements such as cigarette lighter plugs, air line/connectors, air pressure indicators, etc. Thus it is a single unit that is stored and utilized and a stand-alone product. At the same time commercial lifting jacks are store and utilized as a stand-alone product. Both products are distributed through the same channels and used by the same type of consumers.

SUMMARY OF THE INVENTION

Accordingly, the primary object of the present invention is to provide an air compressor that mounts right onto the jack by the use, in this example, of a reverse "u" shape structure built into the housing of the compressor, which allows the compressor to straddle the jack side frames. Therefore the air compressor becomes an integral element of and part of the jack, both for storage and in use.

As there are different designs of jack side plates and compressors this summary does not include all the variations of this basic concept of the union of the compressor to the jack into a single unit.

Another object of the present invention is to provide an air compressor capable of mounting onto the jack, and becoming a single unit, by adding one or more clamping devices to steady and clamp the air compressor onto the side frames of the lifting jack.

A further object of the present invention is to provide a contour inside the top face reversed "u" shape structure of the compressor housing to allow the air compressor to match the shape or contour of the side frames of the lifting jack, thus allowing the compressor to sit in or be clamped in a horizontal inclination.

A yet further object of the present invention is to have receiving chambers in the compressor housing side with built-in covers that allow quick disconnects and storage for the power wire and the air hose of the air compressor.

There are further variations in the object of this present invention which will become apparent from the following detailed description when studied in conjunction with the accompanying drawings.

DETAILED DESCRIPTION OF THE INVENTION

In order that those skilled in the art can further understand the present invention, a detailed description follows. However these descriptions and the accompanying drawings are shown only to assist those skilled in the art to better understand the components, features and characteristics of the present invention, and in no way are to be used to confine the scope and spirit of the present invention as defined in the present claims.

Figure 1:
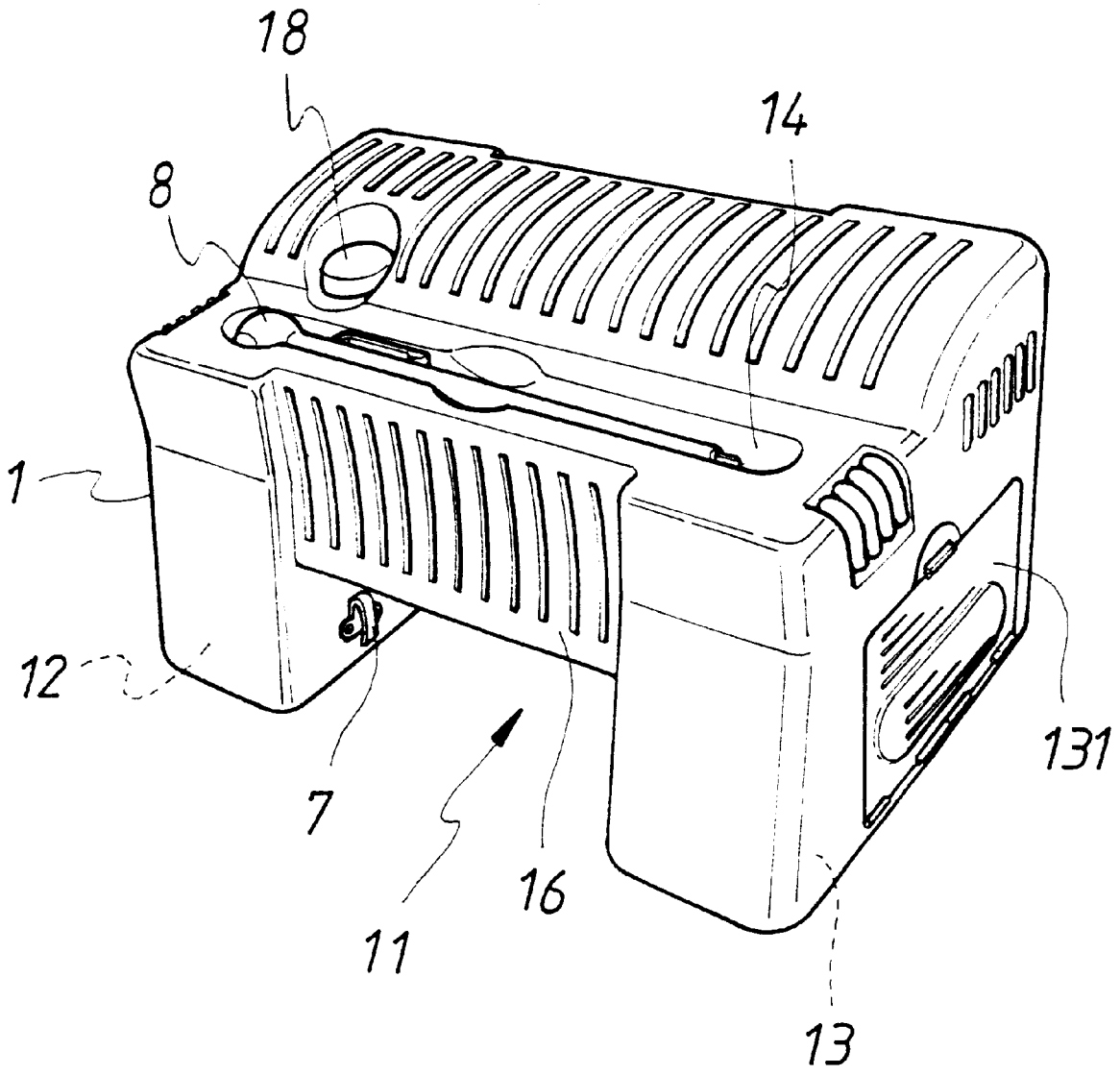
FIG. 1 is a perspective view of the present invention.
Figure 2:
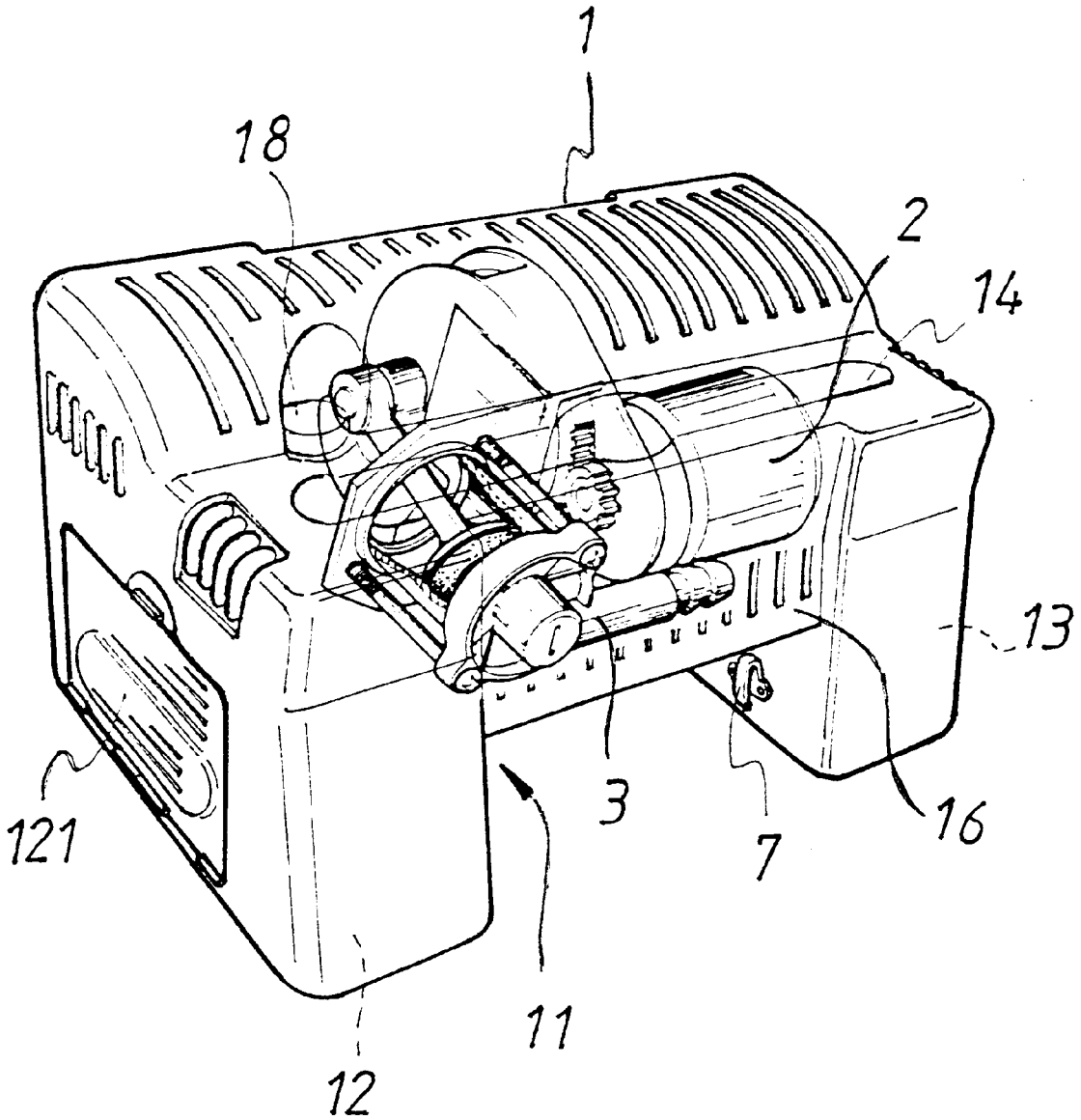
FIG. 2 is a schematic view of the present invention.
Figure 3:
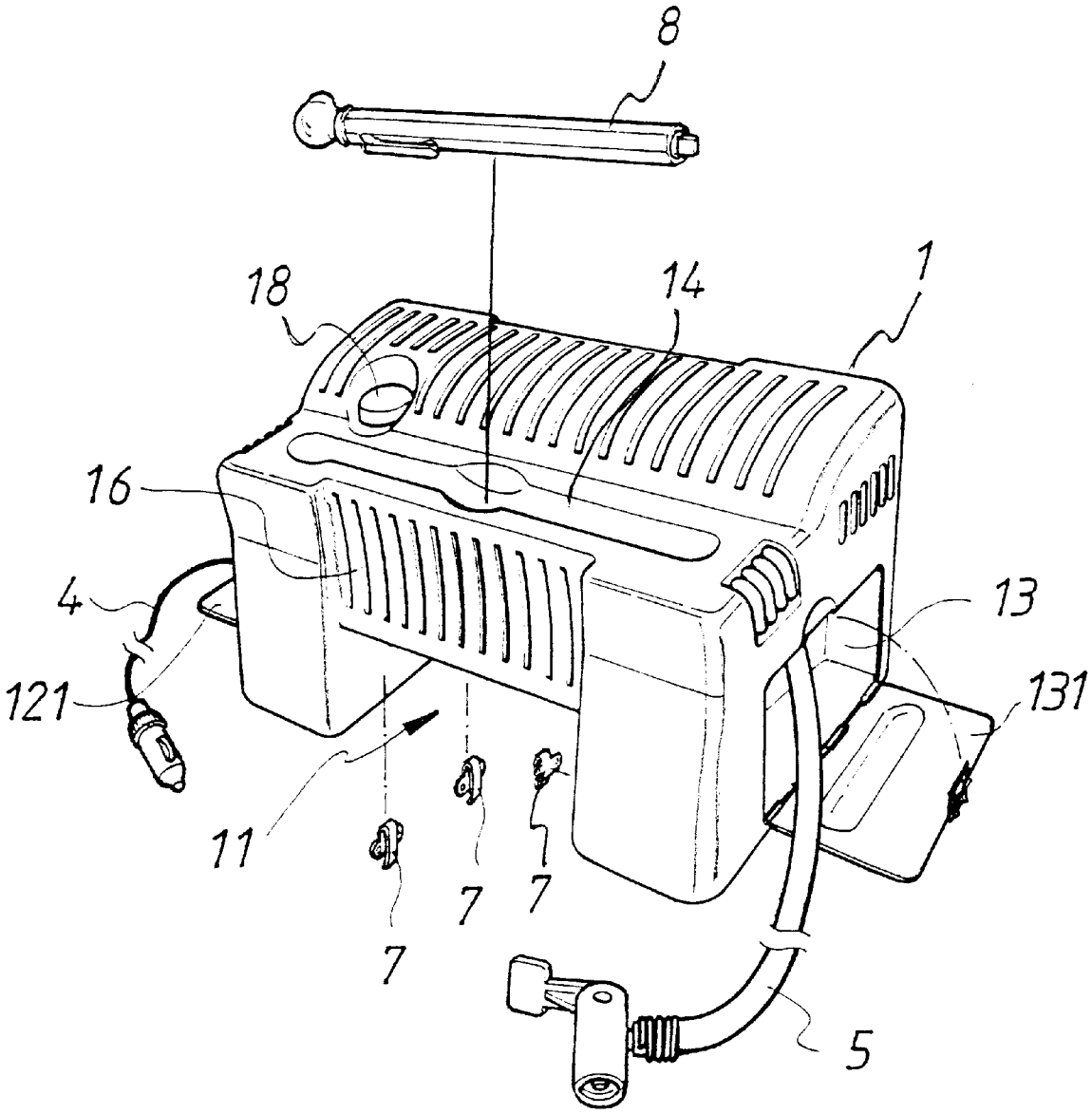
FIG. 3 is a schematic perspective view showing that the present invention is opened.
Figure 6:
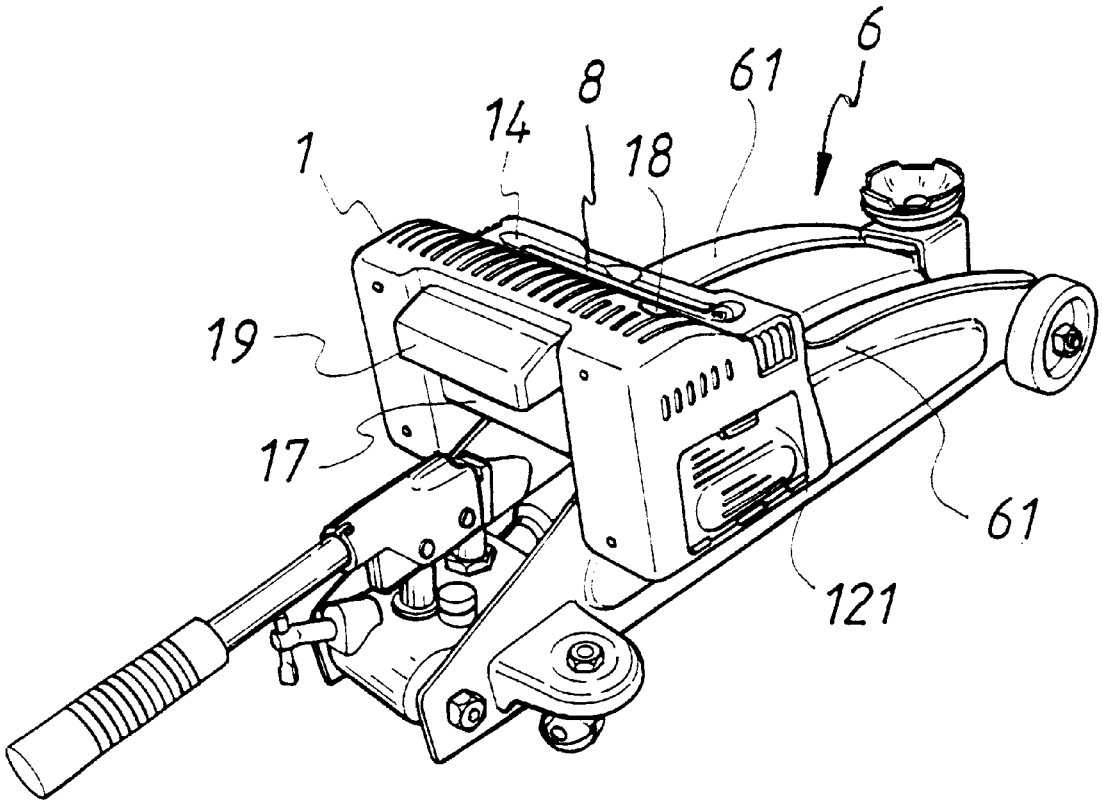
FIG. 6 is a schematic view showing the utilization of the present invention running across a jack.

Referring to FIGS. 1 to 3 shows the air compressor design capable of being mounted integral with the lifting jack. The air compressor typically includes a outer housing 1 a motor 2, a pump 3, power cords 4 a hose/connector 5 etc. Except for the housing 1, all these components are known in prior art as being the components of a regular air compressor and thus the details of the same will not be further described here. The housing has a lower shape with an inverted "u" shape configuration 11 so that it can be placed and located across the two vertical side plates of a jack 61 to be combined therewith (refer to FIG. 6). Thus the air compressor is engaged with the jack to create a single unit in its entirety so that it can be stored, transported and operated conveniently.

Figure 4:
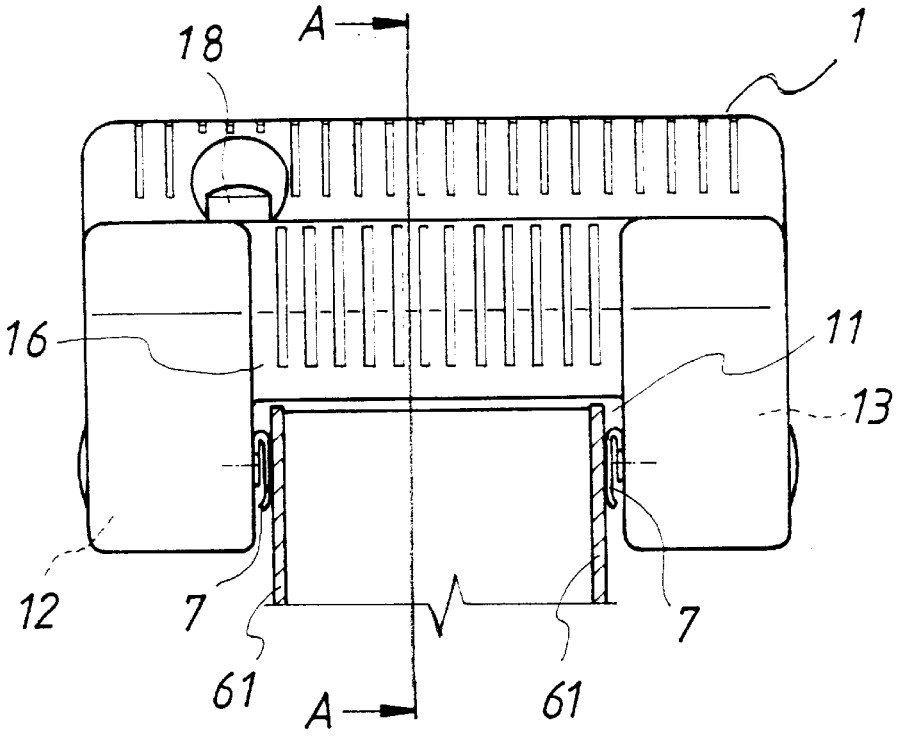
FIG. 4 is a front view of the present invention.

As described above, in the area of the inverted "u" shape of the housing 1 one or both sides of this configuration will have at least one clamping device 7 thus allowing the housing 1 to sit across the two vertical plates of the jack 61, and be steadily clamped thereon (refer to FIG. 4).

In the outer housing 1 of the air compressor, each of the two outer walls of this housing has a storage cavity 12, 13, respectively. Each of these cavities is installed with a cover 121, 122 for opening and closing. These cavities create storage for the power cord 4 and the hose/connector 5 when the unit is not in use. Furthermore the upper surface of the outer housing 1 is installed with a locating groove for receiving, clamping and storing the cylindrical type air pressure meter 8.

Figure 5:
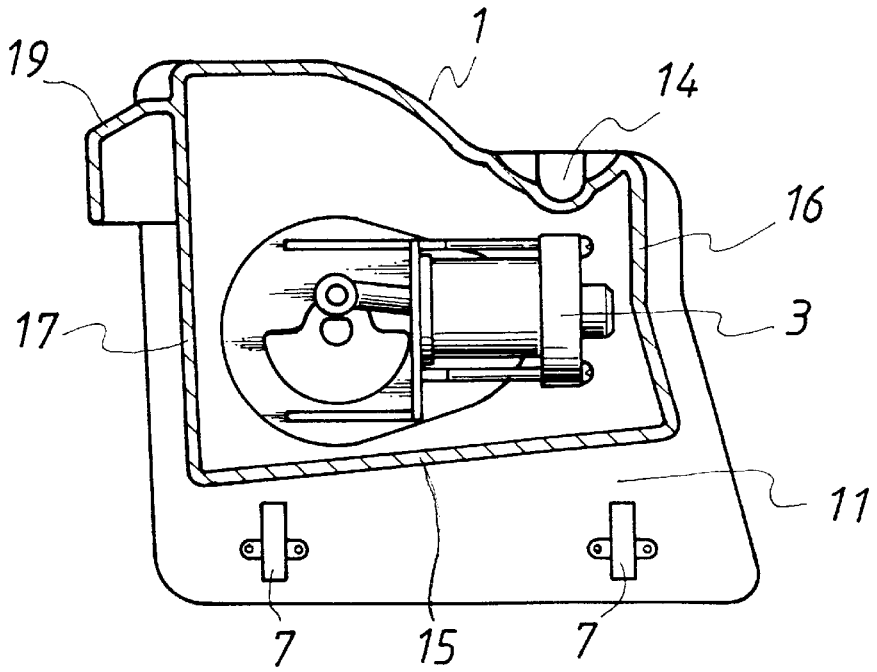
FIG. 5 is a schematic view along the cross sectional view of A—A of the present invention.

Moreover, referring to FIG. 5 the upper wall of the inverted "u" section 11 of the outer housing 1 can be formed with a sloping surface 15 that matches the top sloping edge of the two vertical side plates. Thereby the outer housing of the air compressor can be mounted and clamped in a horizontal orientation. Furthermore the sloping surface 15 can be ignored if the two vertical side plates of the lifting jack are reasonably vertical by utilizing the front and rear vertical faces 16 and 17 of the outer to housing 1 to clamp the air compressor to the two vertical side plates of the lifting jack to maintain the horizontal orientation of the air compressor.

Similarly the outer housing 1 of the air compressor can be installed with an actuating button 18 at any selected position for anytime operation of the air compressor and a handle 19 at any selected position for carrying of the air compressor when seperated from the lifting device. The handle 19 can be a molded in as part of the housing or a separately attached and foldable. These are not limited in the present design. A tire pressure indicator, an illuminator, storage tray etc and others can be further installed. A selected surface of the outer housing 1 of the air compressor can be installed with enhancing ribs, textures or other cosmetic features, or heat dissipating holes or slots. However all of these designs are within the scope of the present design.

The present invention is thus described, and it will be obvious that the concept may be varied in many ways. Such variations are not to be regarded as a departure from the spirit and scope of the present invention, and all such modifications or variations as would be obvious.

What is claimed is:

1. An air compressor capable of mounting across a jack comprising an outer housing, a motor, a pump mechanism, a power cord and a hose/connector; the outer housing of the air compressor contains a built-in inverted "u" shape structure at a lower extremity so that it is located across two vertical side plates of the lifting jack to create a single unit in its entirety.

2. The air compressor capable of mounting across a jack as claimed in claim 1, wherein in the inverted "u" shaped feature of the outer housing, at one or both sides of the inner wall are installed with at least one clamping device so that a housing seat of the air compressor mounted on the two vertical side plates of the lifting jack is securely clamped thereupon.

3. The air compressor capable of mounting across a jack as claimed in claim 1, wherein the two outside walls of the outer housing of the air compressor each contain a cavity and a cover respectively, to provide storage for power cords and the hose/connector when the air compressor is not in use.

4. The air compressor capable of mounting across a jack as claimed in claim 1, wherein an outer surface of the air compressor is installed with a locating groove for receiving, clamping and storing a cylindrical type air pressure meter.

5. The air compressor capable of mounting across a jack as claimed in claim 1, wherein an upper wall of the inverted "u" shaped area of the outer housing is formed with a sloping surface that closely matches each top sloping edge of the two vertical side plates of the jack, thus allowing the compressor to be seated and clamped in a horizontal orientation.

6. The air compressor capable of mounting across a jack as claimed in claim 1, wherein a front and a rear end of the inverted "u" shaped area of the outer housing have front and rear lateral walls which have different elevations allowing the compressor to still be located across and clamped to the two vertical side plates of the jack in a reasonably horizontal orientation.

7. The air compressor capable of mounting across a jack as claimed in claim 1, wherein the outer housing of the compressor is installed with an actuating button at a selected position.

8. The air compressor capable of mounting across a jack as claimed in claim 1, wherein the outer housing of the compressor is installed with a variable design handle at a selected position.

* * * * *